US006691548B1

(12) United States Patent
Schnepper

(10) Patent No.: US 6,691,548 B1
(45) Date of Patent: Feb. 17, 2004

(54) PLIER ASSEMBLY

(76) Inventor: Christopher A. Schnepper, 10180 E Bardon Creek Rd., Poplar, WI (US) 54864

( * ) Notice: Subject to any disclaimer, the term of this patent is extended or adjusted under 35 U.S.C. 154(b) by 0 days.

(21) Appl. No.: 10/142,435

(22) Filed: May 10, 2002

(51) Int. Cl.[7] ..... B25B 7/00

(52) U.S. Cl. ..... 72/409.01; 72/409.13; 72/409.19; 72/416

(58) Field of Search ..... 72/409.01, 409.13, 72/409.19, 370.12, 416; 81/421, 422, 424.5

(56) References Cited

U.S. PATENT DOCUMENTS

| | | | | | |
|---|---|---|---|---|---|
| 2,314,884 | A | * | 3/1943 | Klein | 174/84 C |
| 3,171,132 | A | | 3/1965 | Dritz | |
| 3,264,992 | A | | 8/1966 | Beck | |
| D206,679 | S | | 1/1967 | Flenner | |
| 3,574,312 | A | | 4/1971 | Miller | |
| 3,834,026 | A | | 9/1974 | Klein | |
| 3,872,706 | A | * | 3/1975 | Miller | 72/409.11 |
| 4,315,447 | A | * | 2/1982 | Tartaglia et al. | 81/421 |
| 4,499,796 | A | | 2/1985 | Miller | |
| 4,982,631 | A | * | 1/1991 | Lowther | 81/426 |
| 5,022,253 | A | * | 6/1991 | Parlatore | 72/325 |
| 5,367,755 | A | * | 11/1994 | Wood | 29/227 |
| 6,389,937 | B1 | * | 5/2002 | Kang | 81/423 |
| 6,530,099 | B1 | * | 3/2003 | Iwinski | 7/133 |

* cited by examiner

*Primary Examiner*—Ed Tolan

(57) ABSTRACT

A plier assembly includes a first member that has a handle portion designed to be gripped by the hand of a user. The first member has an attachment portion for facilitating attachment to the second member. The first member has a jaw portion designed to be operationally coupled to a brake line. A second member has a handle portion designed to be gripped by the hand of a user. The second member has an attachment portion for facilitating attachment to the first member. The second member has a jaw portion designed for operationally coupling to a brake line. The second member is pivotally coupled to the first member. A plurality of rubber tip members are operationally coupled to the jaw portions for facilitating a seal for the brake line.

12 Claims, 4 Drawing Sheets

PLIER ASSEMBLY

BACKGROUND OF THE INVENTION

1. Field of the Invention

The present invention relates to pliers and more particularly pertains to a new plier assembly for fulfill the need for an easy way to keep brake fluid from leaking when removing a disk brake system caliper.

2. Description of the Prior Art

The use of pliers is known in the prior art. U.S. Pat. No. 3,834,026 describes a crown remover for removing dental crowns. Another type of pliers is U.S. Pat. No. 4,499,796 describes a fluid pressure releasing tool for opening and holding a check valve in an open position to release hydraulic fluid in a hose. U.S. Pat. No. 3,171,132 describes a plier device for facilitating the application of relatively small metallic objects to sheets of material. U.S. Pat. No. 3,264,992 describes a tamping plug used in blasting rock or coal. U.S. Pat. No. 3,574,312 describes a closure for installation over the ends of pipes or rocklike objects. U.S. Pat. No. Des. 206,679 describes an ornamental design for a pair of expansion pliers.

SUMMARY OF THE INVENTION

The object of the present invention is to provide a new plier assembly that would be of simple design and easy to produce.

Another object of the present invention is to provide a new plier assembly that would save the user time avoid becoming frustrated when working with brake lines.

To this end, the present invention generally comprises a first member that has a handle portion designed to be gripped by the hand of a user. The first member has an attachment portion for facilitating attachment to the second member. The first member has a jaw portion designed to be operationally coupled to a brake line. A second member has a handle portion designed to be gripped by the hand of a user. The second member has an attachment portion for facilitating attachment to the first member. The second member has a jaw portion designed for operationally coupling to a brake line. The second member is pivotally coupled to the first member. A plurality of rubber tip members are operationally coupled to the jaw portions for facilitating a seal for the brake line.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
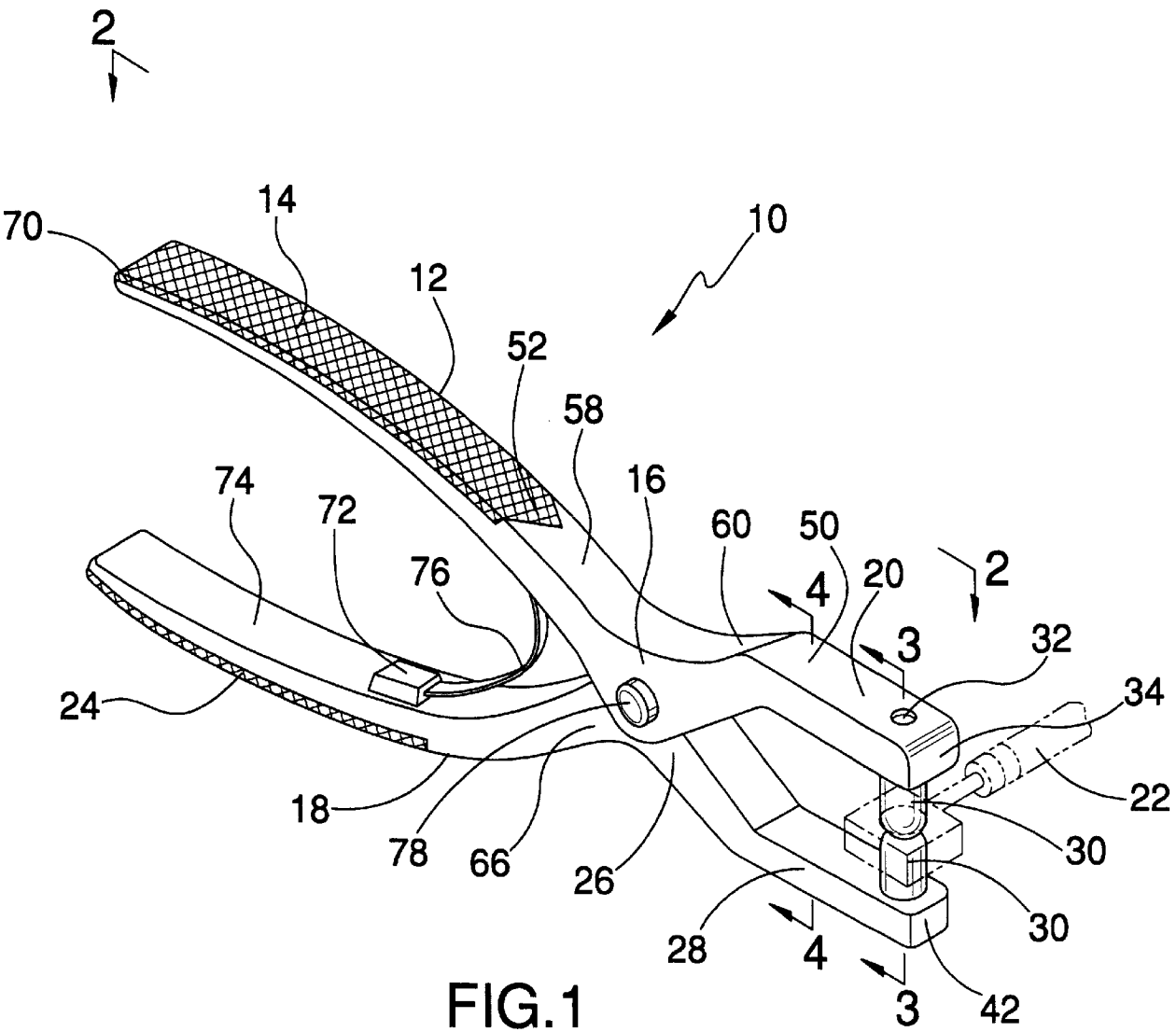
FIG. 1 is a perspective view of a new plier assembly according to the present invention.
Figure 2:
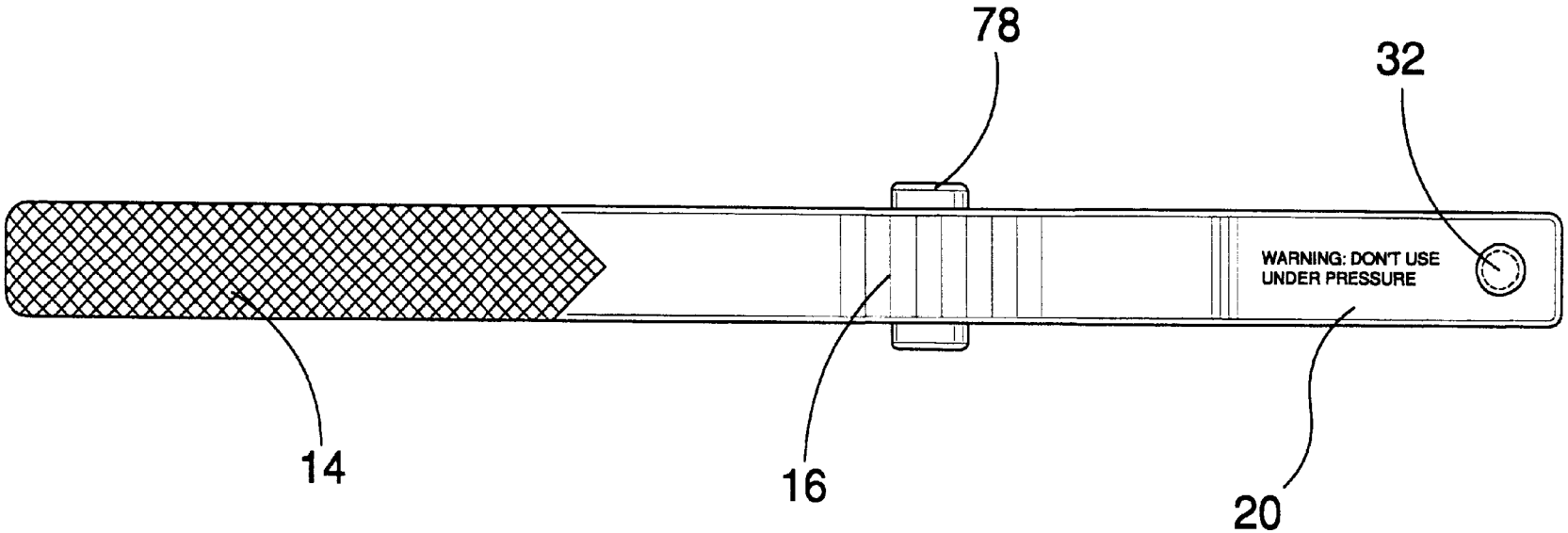
FIG. 2 is a top view of the present invention.
Figure 3:
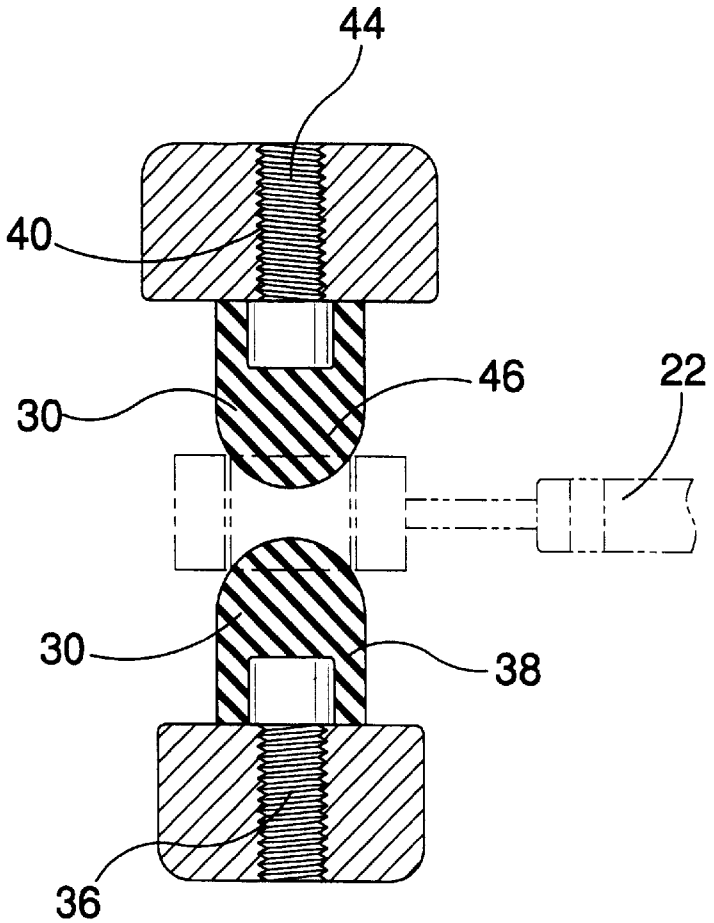
FIG. 3 is a cross-sectional view of the present invention.
Figure 4:
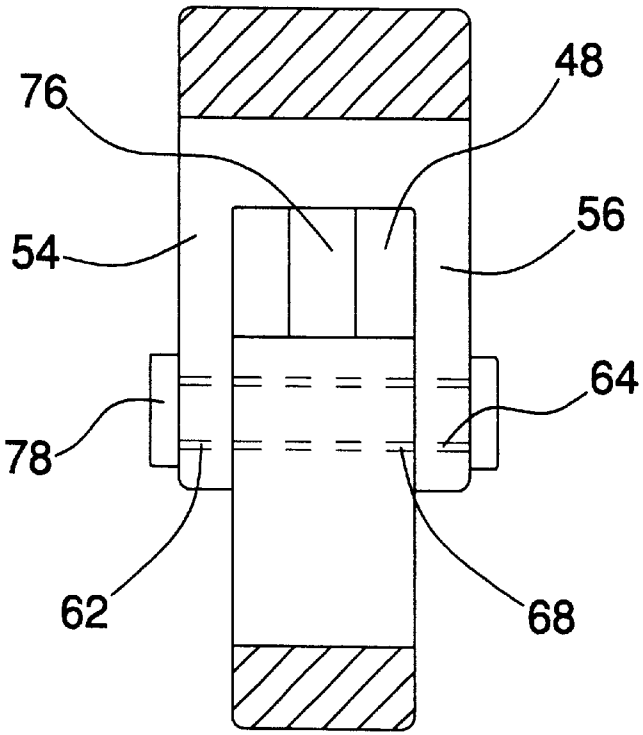
FIG. 4 is a cross-sectional view of the present invention.

With reference now to the drawings, and in particular to FIGS. 1 through 4 thereof, a new plier assembly embodying the principles and concepts of the present invention and generally designated by the reference numeral 10 will be described.

As best illustrated in FIGS. 1 through 4, the plier assembly 10 generally comprises a first member 12 that has a handle portion 14 designed to be gripped by the hand of a user. The first member 12 has an attachment portion 16 for facilitating attachment to the second member 18. The first member 12 has a jaw portion 20 designed to be operationally coupled to a brake line 22. A second member 18 has a handle portion 24 designed to be gripped by the hand of a user. The second member 18 has an attachment portion 26 for facilitating attachment to the first member 12. The second member 18 has a jaw portion 28 designed for operationally coupling to a brake line 22. The second member 18 is pivotally coupled to the first member 12. A plurality of rubber tip members 30 are operationally coupled to the jaw portions 20,28 for facilitating a seal for the brake line 22.

The first member 12 has a first jaw portion 20 that has a bore 32. The bore 32 is positioned near a distal end 34 of the first jaw portion 20. The bore 32 is threadably coupled to a threaded portion 36 of a first rubber tip member 38. A second member 18 has a second jaw portion 28 having a second bore 40. The second bore 40 is positioned near a distal end 42 of the second jaw portion 28. The second bore 40 is threadably coupled to a threaded portion 44 of a second rubber tip member 46.

The first member 12 has an attachment portion 16. The attachment portion 16 is positioned medially on the first member 12. The attachment portion 16 is for coupling the first member 12 to the second member 18.

The attachment portion 16 of the first member 12 has a channel 48 that extends longitudinally from a proximal end 50 of the first jaw portion 20 to a proximal end 52 of a first handle portion 24. The channel 48 is for receiving a second attachment portion 26 of the second member 18. The first member 12 has a first side 54 and a second side 56. The first 54 and second 56 sides are in a substantially parallel relationship separated by the channel 48. Each of the first 12 and second 18 members are integrally coupled such that the proximal end 52 of the handle portion 14 abuts a first end 58 of the attachment portion 16,26 and a second end 60 of the attachment portion 16,26 abuts a proximal end 50 of the jaw portion 20.

The first side 54 of the attachment portion 16 has a first aperture 62 that is alignable with a second aperture 64 of the second side 56 of the attachment portion 16. The first side 54 and the second side 56 is for facilitating coupling of the first member 12 to the second member 18.

The second member 18 has a second attachment portion 66. The second attachment portion 66 has a third aperture 68 for coupling with the first 62 and the second 64 apertures of the first attachment portion 16.

Each of the handle portions 14, 24 extend from the first end 58 of and associated one of the attachment portions 16,26 to a distal end 70 of the handle portion 14, the handle portion 14 has a knarled surface located on the handle portion 14 of the first 12 and second 18 members for facilitating gripping by the hand of a user.

The plurality of rubber tip members 30 are positioned near a distal end of the jaw portions 20,28. The rubber tip members 30 are for sealing the end of a brake line 22 such that fluid cannot drip from the brake line 22.

A pair of pockets 72 are positioned on a inner side 74 near the proximal end 52 of the handle portions 14,24 of the first 12 and second 18 members. The pockets 72 are for receiving the ends of a biasing member 76. The biasing member 76 is for providing a compressive force between the plurality of rubber tip members 30.

A pin member 78 extends through the first 62, second 64, and third 68 apertures of the attachment portions 16 of the first 12 and the second 18 members. The pin member 78 is for coupling the first member 12 to the second 18 member.

In use, just prior to disconnecting the line from the caliper, the user would simply squeeze the handle portions of the present invention to open the jaws portions, position the jaw portions on either side of the brake line, and then release the handle portions. The action of the biasing member would close the rubber tip members of the jaws onto the line, pinching the line closed, and allowing the present invention to simply hang from the line, until the user was ready to remove it.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A plier assembly for use in pinching a brake line to prevent the leaking of brake fluid, comprising:

a first member having a handle portion, said first member having an attachment portion for facilitating attachment to a second member;

said second member having a handle portion such that said handle portion of said second member and said handle portion of said first member are adapted for being gripped by the hand of a user when the user wishes to hold said first member and said second member, said second member having an attachment portion for facilitating attachment to said first member, said second member being pivotally coupled to said first member; and a plurality of rubber tip members being operationally coupled to said jaw portions, each of said rubber tit members being adapted for engagine the brake line such that said rubber tip member are for facilitating a seal for the brake line, each of said rubber tip members comprising a domed end positioned opposite said jaw portions such that said domed end of each of said rubber tip members is adapted for extending into an bore of a mounting fixture coupled of the brake line to inhibit brake fluid from leaking from the mounting fixture.

2. The assembly of claim 1, wherein said first member has a first jaw portion having a bore, said bore being positioned near a distal end of said first jaw portion, said bore being threadably coupled to a threaded portion of a first rubber tip member.

3. The assembly of claim 1, wherein a second member has a second jaw portion having a second bore, said second bore being positioned near a distal end of said second jaw portion, said bore being threadably coupled to a thread portion of a second rubber tip member.

4. The assembly of claim 1, wherein said first member has an attachment portion, said attachment portion being positioned medially on said first member, said attachment portion being for coupling said first member to said second member.

5. The assembly of claim 4, wherein said attachment portion of said first member has a channel extending longitudinally from a proximal end of said first jaw portion to a proximal end of a first handle portion, said channel being for receiving a second attachment portion of said second member, wherein said first member has a first side and a second side, said first and second sides being in a substantially parallel relationship separated by said channel, each of said first and second members are integrally coupled such that said proximal end of said handle portion abuts a first end of said attachment portion and a second end of said attachment portion abuts a proximal end of said jaw portion.

6. The assembly of claim 5, wherein said first side of said attachment portion has an first aperture alignable with a second aperture of said second side of said attachment portion, said first side and said second side being for facilitating coupling of said first member to said second member.

7. The assembly of claim 5, wherein said second member has a second attachment portion, said second attachment portion has a third aperture for coupling with said first and said second apertures of said first attachment portion.

8. The assembly of claim 5, wherein each of said handle portions extend from said first end of and associated one of said attachment portions to a distal end of said handle portion, said handle portion having a knurled surface for facilitating gripping by the hand of a user.

9. The assembly of claim 1, wherein said plurality of rubber tip members are positioned near a distal end of said jaw portions, said rubber tip members being for stealing the end of a brake line such that fluid cannot drip from the brake line.

10. The assembly of claim 1, wherein a pair of pockets are positioned on a inner side near said proximal end of said handle portions of said first and second members, said pockets being for receiving the ends of a biasing member, said biasing member, said biasing member being for providing a compressive force between said plurality of rubber tip members.

11. The assembly of claim 1, wherein a pin member extends through said first, second, and third apertures of said attachment portions of said first and said second members, said pin member being for coupling said first member to said second member.

12. A plier assembly for use in pinching a brake line to prevent the leaking of brake fluid, comprising:

a first member having a handle portion, said first member having an attachment portion for facilitating attachment to a second member;

said second member having a handle portion such that said handle portion of said second member and said handle portion of said first member are adapted for being gripped by the hand of a user when the user wishes to hold said first member and said second member, said second member having an attachment portion for facilitating attachment to said first member, said second member being pivotally coupled to said first member;

a plurality of rubber tip members being operationally coupled to said jaw portions, each of said rubber tip members being adapted for engaging the brake line such that said rubber tip member are for facilitating a seal for the brake line, each of said rubber tip members comprising a domed end positioned opposite said jaw portions such that said domed end of each of said rubber tip members is adapted for extending into an bore of a mounting fixture coupled of the brake line to inhibit brake fluid from leaking from the mounting fixture;

wherein said first member has a first jaw portion having a bore, said bore being positioned near a distal end of said first jaw portion, said bore being threadably coupled to a threaded portion of a first rubber tip member;

wherein a second member has a second jaw portion having a second bore, said second bore being positioned near a distal end of said second jaw portion, said bore being threadably coupled to a thread portion of a second rubber tip member;

wherein said first member has an attachment portion, said attachment portion being positioned medially on said first member, said attachment portion being for coupling said first member to said second member;

wherein said attachment portion of said first member has a channel extending longitudinally from a proximal end of said first jaw portion to a proximal end of a first handle portion, said channel being for receiving a second attachment portion of said second member, wherein said first member has a first side and a second side, said first and second sides being in a substantially parallel relationship separated by said channel, each of said first and second members are integrally coupled such that said proximal end of said handle portion abuts a first end of said attachment portion and a second end of said attachment portion abuts a proximal end of said jaw portion;

wherein said first side of said attachment portion has a first aperture alignable with a second aperture of said second side of said attachment portion, said first side and said second side being for facilitating coupling of said first member to said second member;

wherein said second member has a second attachment portion, said second attachment portion has a third aperture for coupling with said first and said second apertures of said first attachment portion;

wherein each of said handle portions extend from said first end of and associated one of said connection portions to a distal end of said handle portion, said handle portion having a knurled surface located on said handle portion of said first and second members for facilitating gripping by the hand of a user;

wherein said plurality of rubber tip members are positioned near a distal end of said jaw portions, said rubber tip members being for sealing the end of a brake line such that fluid cannot drip from the brake line;

wherein a pair of pockets are positioned on a inner side near said proximal end of said handle portions of said first and second members, said pockets being for receiving the ends of a biasing member, said biasing member, said biasing member being for providing a compressive force between said plurality of rubber tip members; and wherein a pin member extends through said first, second, and third apertures of said attachment portions of said first and said second members, said pin member being for coupling said first member to said second member.

* * * * *